US006482296B1

(12) United States Patent
Fagerlund et al.

(10) Patent No.: US 6,482,296 B1
(45) Date of Patent: Nov. 19, 2002

(54) INTEGRATED MACHINE CONTROL METHOD AND MACHINE CONTROL MODULE

(75) Inventors: John Fagerlund; Harri Vähätalo, both of Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/687,888

(22) Filed: Oct. 13, 2000

(30) Foreign Application Priority Data

Oct. 13, 1999 (FI) ..... 992199
Oct. 13, 1999 (FI) ..... 992200

(51) Int. Cl.[7] ..... D21F 7/00
(52) U.S. Cl. ..... 162/253; 162/262; 700/128
(58) Field of Search ..... 162/198, 199, 162/252–260, 262, 263, 272, 273, DIG. 10, DIG. 11; 700/122, 127, 128, 129, 17, 83, 84

(56) References Cited

U.S. PATENT DOCUMENTS

| | | | | | |
|---|---|---|---|---|---|
| RE30,280 | E | * | 5/1980 | Berman et al. | 290/1 R |
| 5,150,302 | A | * | 9/1992 | Adachi et al. | 700/127 |
| 5,381,341 | A | * | 1/1995 | Herrala et al. | 700/129 |
| 5,421,961 | A | * | 6/1995 | Miller | 162/252 |
| 5,456,871 | A | * | 10/1995 | Harada et al. | 264/40.1 |
| 5,822,208 | A | * | 10/1998 | Bory | 700/108 |
| 5,833,364 | A | * | 11/1998 | Rushing et al. | 366/152.1 |
| 6,056,024 | A | * | 5/2000 | Noah et al. | 141/21 |

* cited by examiner

*Primary Examiner*—Peter Chin
*Assistant Examiner*—Eric Hug
(74) *Attorney, Agent, or Firm*—Steinberg & Raskin, P.C.

(57) ABSTRACT

The present invention relates to a method for controlling a papermaking machine/board machine/tissue machine or the like, which papermaking machine/board machine/tissue machine or the like includes basic unit assembly groups, such as a headbox, a wire section, a press, a drying section, a coating unit, a finishing machine, etc. The machine control system of the papermaking machine/board machine/tissue machine or the like comprises a central processing unit (e.g. a unit for control room, alarm and other such functions), one or more process control units, and one or more input/output units, which are connected by control cables to the controlled units or actuators. In the method the process control units and/or input/output units of the machine control system are located in a mechanical machine part in connection with basic unit assembly groups of the papermaking machine/board machine/tissue machine or such. The invention also relates to an integrated machine control module in the machine control system of a papermaking machine/board machine/tissue machine or such. The integrated machine control module comprises an internal cabinet, wherein the process control units and/or the input/output units of the machine control system are located. Said internal cabinet equipment is arranged for monitoring ambient conditions as well as equipment for removing stresses caused by ambient conditions in such a way that the integrated machine control module can be located in ambient conditions existing in connection with basic unit assembly groups of the papermaking machine.

19 Claims, 6 Drawing Sheets

INTEGRATED MACHINE CONTROL METHOD AND MACHINE CONTROL MODULE

FIELD OF THE INVENTION

The invention concerns a method for controlling a papermaking machine/board machine/tissue machine or the like, which papermaking machine/board machine/tissue machine or the like includes basic unit assembly groups, such as a headbox, a wire section, a press, a drying section, a coating unit, a finishing machine etc., and wherein the machine control system of the papermaking machine/board machine/tissue machine includes a central processing unit (e.g. a unit for control room, alarm and other such functions), one or more process control units and one or more input/output units connected over control cables with the controlled units or actuators.

The invention also concerns an integrated machine control module for the machine control system of the papermaking machine/board machine/tissue machine or such, which machine control system includes a central processing unit (e.g. a unit for control room, alarm and other such functions), one or more process control units and one or more input/output units as well as data transmission connections between the units.

The present invention is concerned with a machine control system of a papermaking machine and with the location of components of the machine control system. In this context, a machine control system means machine control, process control, quality control and monitoring systems. The method according to the invention is also suitable for use in machines for reconverting paper/board (printing machines, laminate production).

BACKGROUND OF THE INVENTION

A machine control system for use in controlling a papermaking machine includes process control units and input/output units, which in known solutions are given centralized locations outside the machine components. From the centralized location compartment cables are drawn to the papermaking machine's basic unit assembly groups and the cables are connected with each controlled piece of equipment or machine part. In such an arrangement the process control units and input/output units of the machine control system are located in a compartment intended for electric equipment, wherein they are protected against moisture, temperature variations and other environmental stresses.

In the arrangement described above, a control cable is brought to each controlled unit of the papermaking machine from an assembly compartment, which is located elsewhere and wherein the machine control system's process control units and input/output units are located. This cabling work between the assembly compartment and the basic unit assembly groups is done on the work site where the papermaking machine is installed. The installation work includes drawing of main cables and unit cables, connecting of cable ends and testing of cable connections. The above-mentioned connecting work is done after the installation of the mechanical machine and it thereby considerably prolongs the time needed for installation of the papermaking machine.

Locating the equipment units of the machine control system together with the basic unit assembly groups of the paper making machine's is prevented by the problematic adverse ambient conditions located at each basic unit assembly group of the paper making machine, where high temperatures, moisture and harmful concentrations is a common occurrence and prevents the locating of sensitive electronic components thereabout. The present encapsulation of the machine control system does not provide adequate protection against ambient conditions, nor is any monitoring associated with protection arranged for the electromechanical equipment used today. For this reason, the input/output units and control units of the machine control system are located outside the paper making machine's basic unit assembly groups, where suitable conditions for computer and electronic components can easily be arranged.

OBJECTS AND SUMMARY OF THE INVENTION

It is a purpose of the present invention to bring about such an arrangement, wherein the input/output units and/or process control units of the machine control system can be located in connection with the papermaking machine's basic unit assembly groups.

It is yet another purpose of the invention also to bring about such an arrangement, wherein the units of the machine control system are located in connection with the papermaking machine's basic unit assembly groups in a compartment, wherein the temperature and moisture conditions within the protected compartment are monitored.

In addition, it is a purpose of the present invention to bring about such a method, by which cabling is reduced between the process control and input/output units of the machine control system and the controlled actuators located in the basic unit assembly groups.

An additional purpose of the invention is to bring about such a method, by which the input/output units of the machine control system are located in connection with the basic unit assembly groups of the papermaking machine.

An additional purpose of the invention is to bring about such a method, by which the process control units of the machine control system are located in connection with the basic unit assembly groups of the papermaking machine.

An additional purpose of the invention is to bring about such a method, by which the process control units and/or input/output units of the machine control system to be located in connection with the basic unit assembly groups of the papermaking machine are protected against stresses and vibrations from the existing environment.

An additional purpose of the invention is to bring about such a method, by which the cabling between the machine control system and the equipment to be connected therewith is performed and tested before the papermaking machine is delivered to the customer.

To achieve the said objectives as well as those emerging hereinafter, the method according to the invention is characterized mainly in that in the method the process control units and/or input/output units of the machine control system are located in a mechanical machine part in connection with the basic unit assembly groups of the papermaking machine/board machine/tissue machine or such.

The integrated machine control module according to the invention is characterized in that the integrated machine control module includes an internal cabinet, wherein the process control units and/or input/output units of the machine control system are located, and therein the internal cabinet means are arranged for monitoring ambient conditions as well as means for eliminating stresses caused by ambient conditions in such a way that the integrated machine control module can be located in ambient conditions existing in connection with the basic unit assembly groups of the papermaking machine.

Locating the input/output units and/or process control units of the machine control system in connection with the basic unit assembly groups of the papermaking machine will reduce cabling work considerably and will save cable material between the input/output units and the controlled equipment. At the same time, a considerable reduction is achieved in the installation delivery cycle. On the installation site, cabling need be arranged only for the voltage supply and for the bus connection between a part of the centralized system and the input/output units.

In the arrangement according to the invention, the units of the machine control system are located in connection with the mechanical basic unit assembly groups of the paper making machine, the hydraulic centers or other such entities in the same assembly with other automation. Basic unit assembly groups of the papermaking machine are e.g. the headbox, the wire section, the press, the drying section, the on-line/off-line coating units, the on-line/off-line calender and other finishing machines. In the location according to the invention, the process control units and input/output units are protected against temperature, moisture and vibration stresses from the environment by an encapsulation suitable for the purpose.

In the arrangement according to the invention, the units of the machine control system are encapsulated in such a way that temperature measurement, monitoring, pressure measurement and removal of accumulated moisture are arranged within the capsule. Lead-ins of the cabling are arranged to be tightly fitted thereby preventing air around the capsule from entering through the lead-ins.

In the arrangement according to the invention, the units of the machine control system are protected in such a way that their reliable operation will remain at least at the present level, although the ambient conditions of the place of location according to the invention become considerably more difficult compared with earlier practice.

BRIEF DESCRIPTION OF THE DRAWINGS

In the following, the invention will be described in greater detail with reference to the appended drawings, wherein.

DETAILED DESCRIPTION OF THE INVENTION

Figure 1:
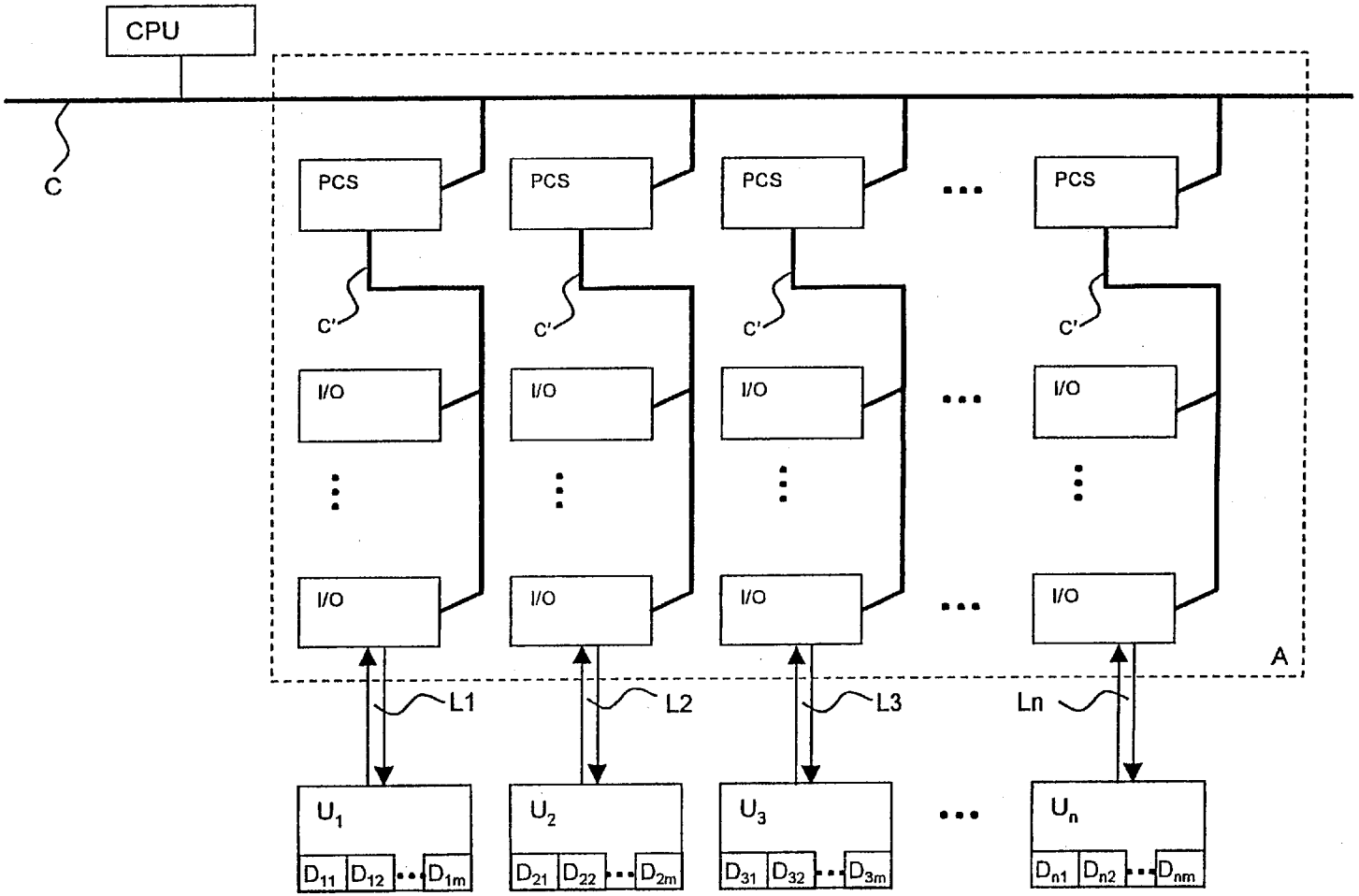
FIG. 1 is a block diagram of a papermaking machine's state-of-the-art machine control system.

FIG. 1 shows in block diagram form the machine control system of a papermaking machine, which includes process control units PCS, input/output units I/O, central processing units CPU as well as a data communication bus C interconnecting the same. From input/output units I/O cabling L1 . . . Ln is drawn to basic unit assembly groups $U_1 \ldots U_n$ of the papermaking machine, which are e.g. a headbox, a wire section, a press, a drying section, on-line/off-line coating units, an on-line/off-line calender and other finishing machines. The machine control system controls actuators located in the basic unit assembly groups $U_1 \ldots U_n$, e.g. valves or pneumatically operating machine parts. Cabling L1 . . . Ln may include tens or hundreds of twin wires, wherein a binary/analog signal is traveling.

According to the state of the art, the process control units PCS and input/output units I/O of the machine control system are located in an assembly compartment A shown by a dashed line, which is located separately from the basic unit assembly groups of the papermaking machine at a location where temperature and moisture conditions are favorable for computer components to exist and operate.

Figure 2:
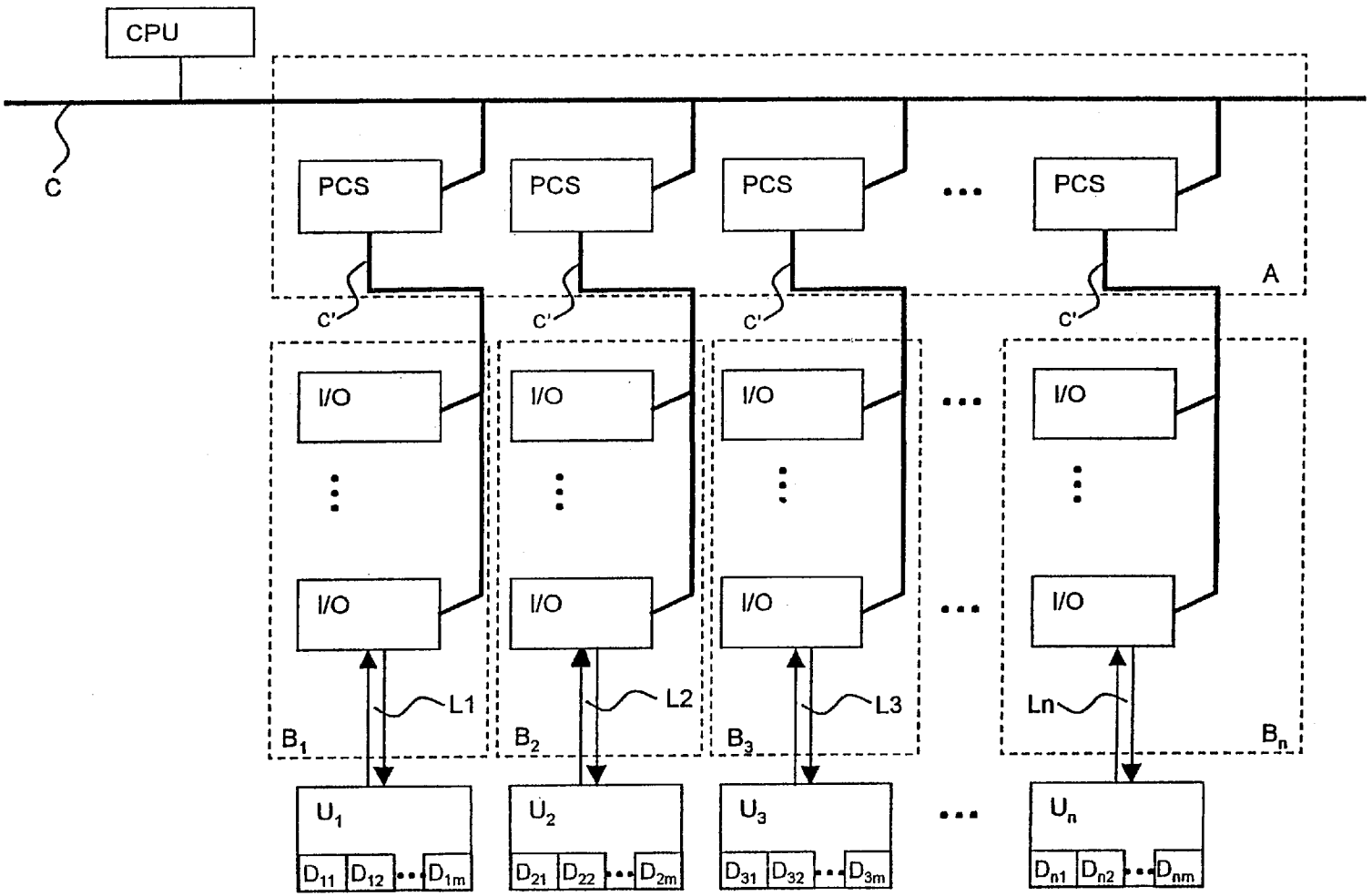
FIG. 2 is a block diagram of a machine control system according to the invention, wherein the input/output units are located in connection with basic unit assembly groups of the papermaking machine.

Between input/output units I/O and basic unit assembly groups $U_1 \ldots U_n$ there is bi-directional control cabling L1 . . . Ln, which transports the control signal from input/output unit I/O to the controlled equipment and the monitoring signal from the controlled equipment to input/output unit I/O. The actuators to be controlled which are located in each basic unit assembly group $U_1 \ldots U_n$ are marked by reference numbers $D_{1l} \ldots D_{1m}; \ldots ; D_{n1} \ldots D_{nm}$. The actuators $D_{1l} \ldots D_{1m}; \ldots ; D_{n1} \ldots D_{nm}$ to be controlled may be located e.g. in the headbox, in the press, on the wire section, in the drying section, in the coating unit, in the calender, in the reel-up, in the cutter or in other finishing machines FIG. 2 shows in block diagram form a machine control system, wherein the input/output units I/O are located in connection with the papermaking machine's basic unit assembly groups $U_1 \ldots U_n$ in protected compartments, which in FIG. 2 are indicated by dashed line areas $B_1 \ldots B_n$. The units located in the dashed line areas are located in a protected cabinet or capsule or such in connection with each basic unit assembly group $U_1 \ldots U_n$ of the papermaking machine, so that the cabling between input/output units I/O and the controlled equipment $D_{1l} \ldots D_{1m}; \ldots ; D_{n1} \ldots D_{nm}$ may be installed and tested beforehand at the paper machine plant. The connection between input/output units I/O and process control units PCS is formed by data communication bus C'.

Figure 3:
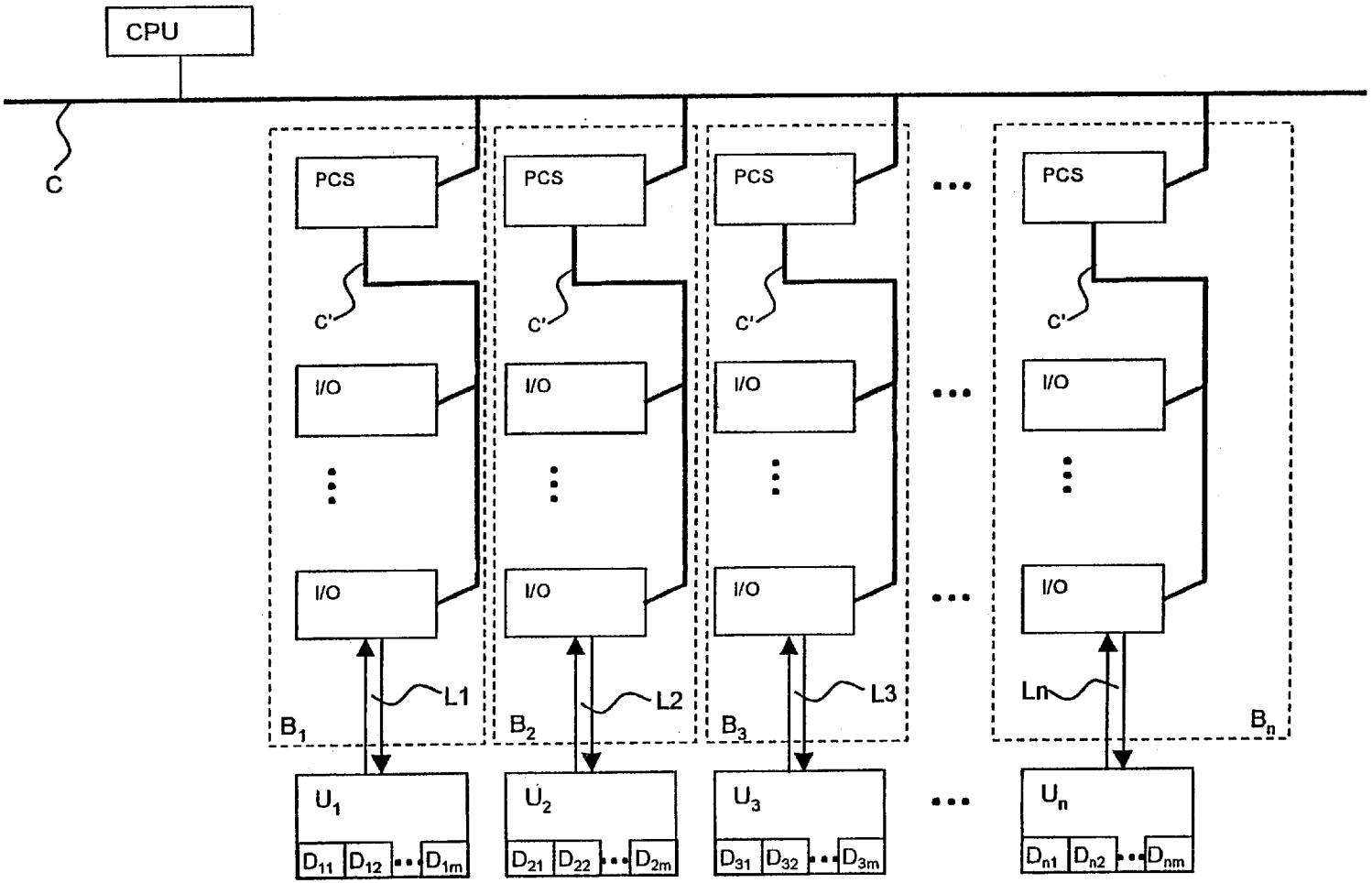
FIG. 3 is a block diagram of a machine control system according to the invention, wherein the input/output units and the process control units are located in connection with basic unit assembly groups of the papermaking machine.

FIG. 3 shows a machine control system according to the invention, wherein both the process control units PCS and the input/output units I/O are located in protected compartments (dashed line areas $B_1 \ldots B_n$) located in connection with basic unit assembly groups $U_1 \ldots U_n$ of the papermaking machine. A data communication bus C is introduced into the process control units PCS located in the protected compartment $B_1 \ldots B_n$ of each basic unit assembly group $U_1 \ldots U_n$ thereby forming a connection between process control units PCS and the other parts of the machine control system. The connection between process control units PCS and input/output units I/O is brought about by a data communication bus C'. The process control units PCS located in each basic unit assembly group $U_1 \ldots U_n$ also communicate with each other through data communication bus C.

With the method according to the invention, it is possible for the components PCS and the I/O of the machine control system located in the papermaking machine's basic unit assembly groups to form an integrated machine control module, which is located in a protected compartment. FIG.

4 shows an example of a papermaking machine's wire section, wherein two integrated machine control modules I1, I2 are located in connection with the papermaking machine's basic unit assembly group in a compartment, wherein input/output units I/O and/or process control units PCS (the components located within the dashed line areas $B_1 \ldots B_n$ in FIG. 2 or 3) are located. The input/output units I/O and/or process control units PCS belonging to the machine control system are typically located in connection with basic unit assembly groups $U_1 \ldots U_n$ so that in the same connection there are also the components of hydraulics, pneumatics, lubrication, vibration control and electronics, to which the integrated machine control module is connected.

Figure 4:
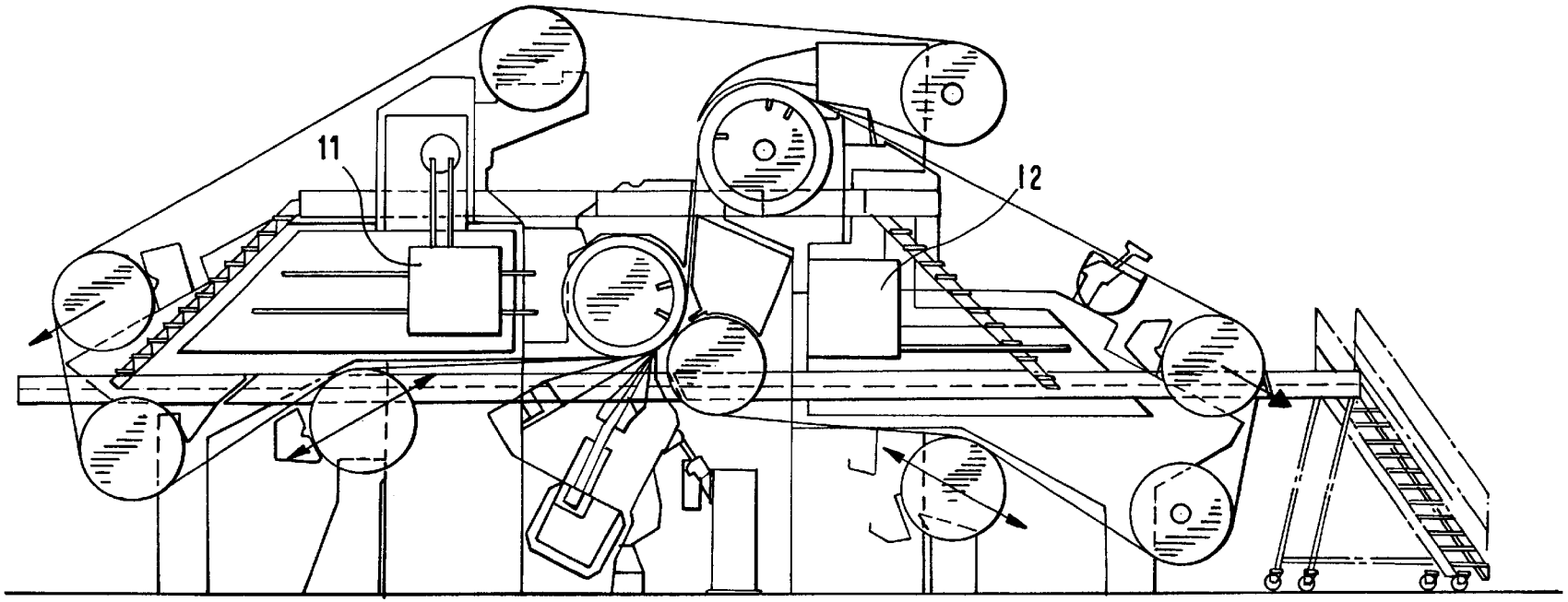
FIG. 4 is an elevational view of a basic unit assembly group of a paper machine showing an example of the location of input/output units and/or process control units of the machine control system.

In the examples shown in FIG. 4, the integrated machine control module I1 and I2 controls and measures/monitors e.g. electrically, hydraulically or pneumatically operating actuators (regulating valves, magnetic valves), limit switches, pressure transmitters, temperature transmitters, and others, such as vibration sensors, position sensors and such.

Figure 5:
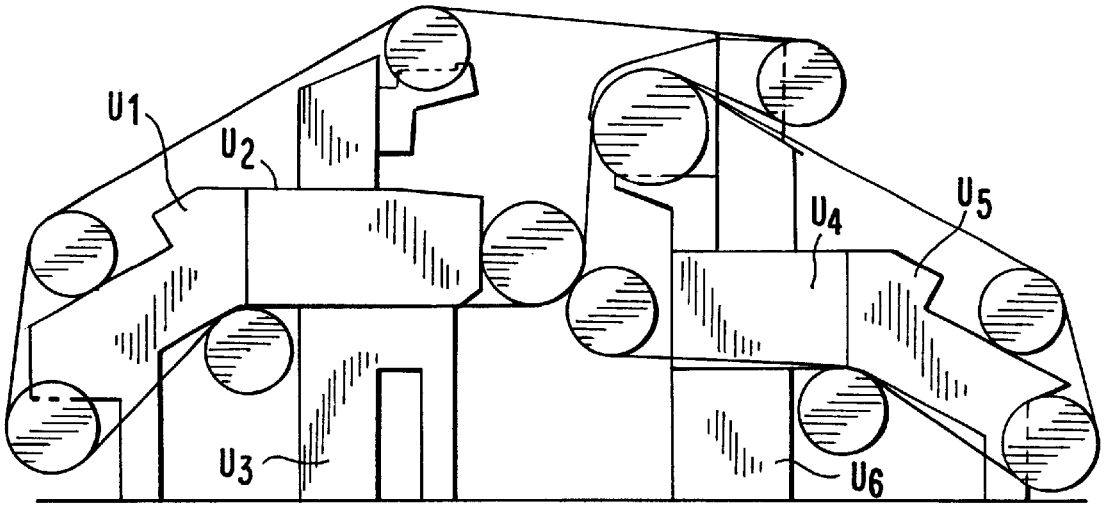
FIG. 5 is an elevational view of the papermaking machine's basic unit modules, each one of which is controlled by an integrated machine control method in accordance with the invention.

FIG. 5 shows an example of a papermaking machine's structural entities, each one of which can be controlled by one integrated machine control module of the machine control system located in the basic unit assembly group, which integrated machine control module includes process control and/or input/output units. In the example shown in FIG. 5, the basic unit assembly group of the papermaking machine includes six mechanical structural blocks $U_1 \ldots U_6$, in each one of which an own integrated machine control module may be located. These integrated machine control modules are connected with each other by a data communication bus, whereby they may exchange data on the functions or state of each other. Each integrated machine control module is also connected with the others parts of the machine control system by the data communication bus.

Figure 6:
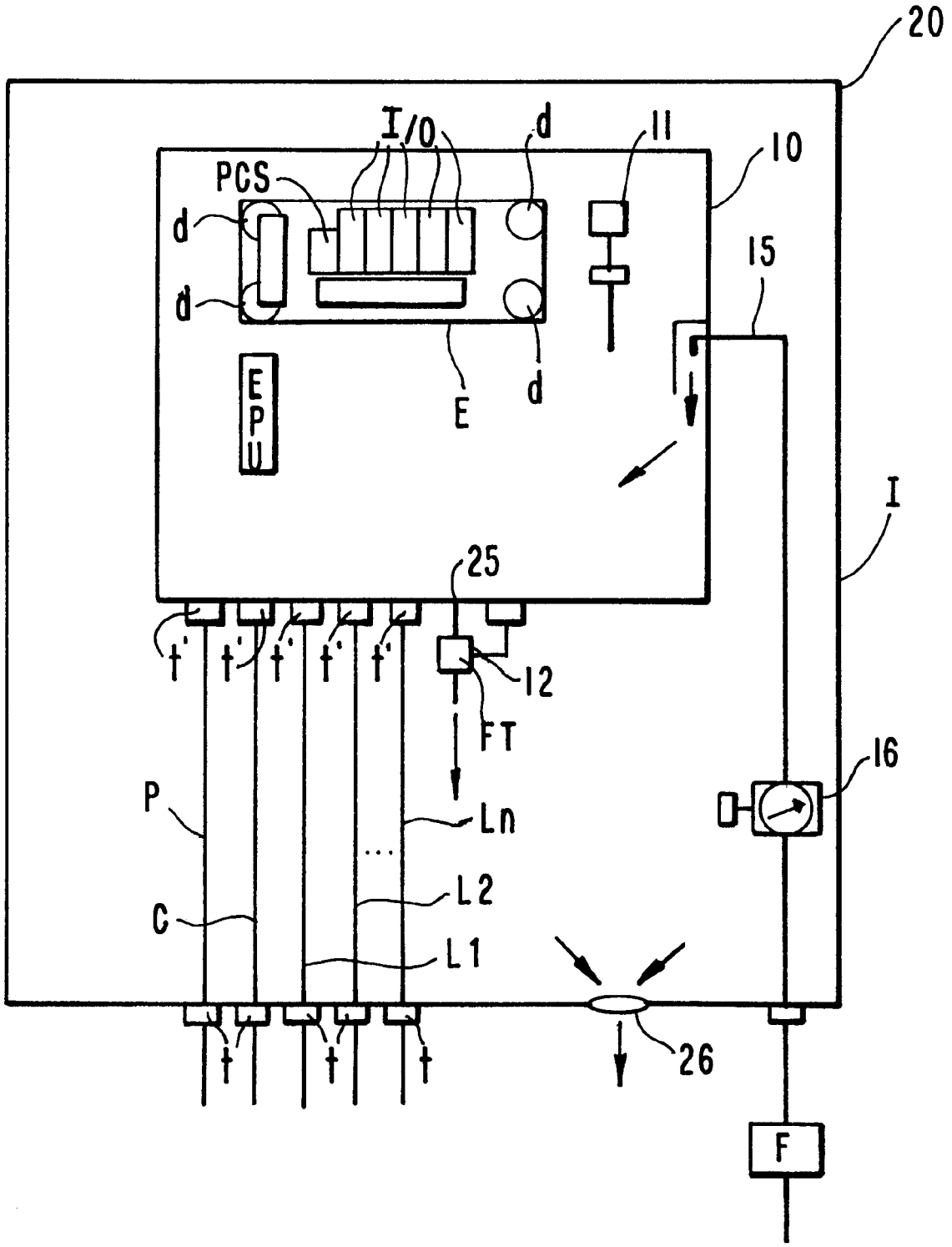
FIG. 6 shows an integrated machine control module according to the invention.

FIG. 6 shows an integrated machine control module I according to the invention, which preferably includes double encapsulation, so that within an external cabinet 20 an internal cabinet 10 is located, wherein the machine control system's input/output units I/O are located, from which control cables L1 . . . Ln are arranged to the controlled equipment. The machine control system's process control units PCS may also be located in the internal cabinet, but these may also be located in a separate assembly compartment outside the basic unit assembly groups of the papermaking machine.

The double encapsulation efficiently prevents the electronic components located in internal cabinet 10 from being exposed to ambient conditions. Hydraulic, pneumatic and electric equipment relating to the papermaking machine's automation may be located in the external cabinet 20 outside internal cabinet 10, possibly similarly protected, whereby they will be in the same mechanical assembly as the units of the machine control system.

Lead-in of the cables required in the integrated machine control module I is arranged through tight lead-ins t into external cabinet 20 and further through lead-ins t' into internal cabinet 10. A power supply cable P, data communication bus C (system bus or I/O bus) and control cables L1 . . . Ln for the controlled equipment are brought into the integrated machine control module I.

Input/output units I/O and process control units PCS are typically in the form of electronic cards, which are installed in electronics frame E. To frame E the data communication bus C is brought from the machine control system, through which bus C the units of the integrated machine control system communicate with the other parts of the machine control system and with other systems of the papermaking machine, such as e.g. the electric drives or the quality control system.

Electronics frame E within internal cabinet 10 is equipped with vibration dampers d, which protect units to be connected to electronics frame E against disturbing vibrations caused by the papermaking machine environment.

Through external cabinet 20 supply channel 15 for trimming air is brought into internal cabinet 10, which channel supplies trimming air continuously into internal cabinet 10. The supply channel 15 for trimming air is equipped with a pressure reducer 16, which is used for regulating a suitable flow rate of trimming air. The air supplied to internal cabinet 10 flows through internal cabinet 10 and exits by way of fitting 25. The small airflow through internal cabinet 10 will remove moisture and other impurities entering the cabinet during maintenance. The flow-through causes a slight overpressure in ex tern al cabinet 20, whereby removal through condensation water exit opening 26 of water condensing in external cabinet 20 will become more efficient.

A temperature detector 11 and a moisture detector 12 are located within internal cabinet 10 for use in monitoring that conditions within internal cabinet 10 will remain suitable for the operation of the machine control system's units. Temperature and moisture detectors 11, 12 may be provided with transmitters, which send temperature and moisture data to the monitoring unit. In case permissible temperature and moisture limits are exceeded, the papermaking machine's monitoring system will receive an alarm. Typically, leaving the door of the integrated machine control module I open will result in an alarm.

Although the invention was described in the foregoing by way of example in connection with a wire section, the invention may also be applied just as well in other basic unit assembly groups.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

We claim:

1. A method for controlling a papermaking machine, board machine or tissue machine, which papermaking machine, board machine or tissue machine includes basic unit assembly groups ($U_1 \ldots U_n$), such as a headbox, a wire section, a press, a drying section, a coat unit or a finishing machine, and wherein a machine control system of the papermaking machine, board machine or tissue machine includes a central processing unit (CPU), one or more process control units (PCS) connected to said central processing unit (CPU), and one or more input/output units (I/O), connected by control cables (L1 . . . Ln) to the controlled units or actuators ($D_{1l} \ldots D_{1m}$; $D_{n1} \ldots D_{nm}$), comprising the steps of:

locating said process control units (PCS) and/or input/output units (I/O) of the machine control system within a mechanical machine part in the basic unit assembly groups of the papermaking machine, board machine or tissue machine or such, and protecting said process control units (PCS) and/or said input/output units (I/O) against ambient conditions, such as temperature variations, vibration, moisture and impurities by protective encapsulation.

2. The method as defined in claim 1, further comprising the step of:

connecting said control cables (L1 . . . Ln) with said input/output units (I/O) at a paper machine plant.

3. The method as defined in claim 1, further comprising the step of locating said process control units (PCS) and/or said input/output units (I/O) in connection with basic unit assembly groups ($U_1$ . . . $U_n$) of said papermaking machine in a same compartment as hydraulics, pneumatics, electricity, or vibration control automation.

4. The method as defined in claim 1, further comprising the step of connecting said process control units (PCS) located in connection with basic unit assembly groups ($U_1$ . . . $U_n$) of said papermaking machine to one another by a data communication bus (C).

5. The method as defined in claim 1, further comprising the step of:

connecting said input/output units (I/0) located in connection with basic unit assembly groups ($U_1$ . . . $U_n$) of said papermaking machine to said process control unit (PCS) by a data communication bus (C').

6. The method as defined in claim 1, further comprising the step of connecting said process control units (PCS) and said input/output units (I/O) located in connection with basic unit assembly groups ($U_{1 \ldots Un}$) of said papermaking machine to at least one of a remaining machine control system through a data communication bus (C).

7. An integrated machine control module (I) in a machine control system of a papermaking machine, board machine or tissue machine, which machine control system includes a central processing unit (CPU), one or more process control units (PCS) and one or more input/output units (I/O) all interconnected by data communication connections (C) between each of the units, wherein the integrated machine control module (I) comprises:

an internal cabinet (10) for housing said process control units (PCS) and/or said input/output units (I/O) of said machine control system therein;

monitoring means structured and arranged within said internal cabinet (10) for monitoring ambient conditions within said cabinet, and stress removing means for removing stresses caused by said ambient conditions in such a way so that said integrated machine control module (I) is located in ambient conditions existing in connection with basic unit assembly groups of said papermaking machine.

8. The integrated machine control module as defined in claim 7, wherein said process control units (PCS) and/or said input/output units (I/O) of said machine control system are attached to an electronics frame (E).

9. The integrated machine control module as defined in claim 8, wherein said electronics frame (E) is protected by vibration dampers (d).

10. The integrated machine control module as defined in claim 7, further comprising:

a temperature, moisture and/or vibration detector (11) structured and arranged within said internal cabinet (10).

11. The integrated machine control module as defined in claim 7, further comprising:

a pressure detector (12) structured and arranged in said internal cabinet (10).

12. The integrated machine control module as defined in claim 7, further comprising:

a flow-through of trimming air structured and arranged in said internal cabinet (10).

13. The integrated machine control module as defined in claim 12, further wherein said trimming air is brought into said internal cabinet (10) through a supply channel (15).

14. The integrated machine control module as defined in claim 13, further comprising:

a pressure regulator (16) connected to said supply channel (15) in order to regulate the flow rate of the trimming air.

15. The integrated machine control module as defined in claim 7, further comprising:

a plurality of tight cable lead-ins (t') for a power supply cable (P), for control cables (L1 . . . Ln) of said equipment to be controlled by said machine control system and for said data communication bus cable (C) arranged within said internal cabinet (10).

16. The integrated machine control module as defined in claim 7, further comprising:

a trimming air flow detector (12) for monitoring and ensuring that a door of said internal cabinet (10) remains closed.

17. The integrated machine control module as defined in claim 7, wherein said internal cabinet (10) is located within an external cabinet (20).

18. The integrated machine control module as defined in claim 17, wherein said external cabinet (20) further comprises:

a condensation water removal system (26).

19. The integrated machine control module as defined in claim 17, further comprising:

a plurality of tight cable lead-ins (t) structured and arranged in said external cabinet (20) for passage of a power supply cable (P), a plurality of control cables (L1 . . . Ln) of said equipment to be controlled by said machine control system and for a data communication bus cable (C).

* * * * *